United States Patent [19]

Bonin

[11] 4,041,919

[45] Aug. 16, 1977

[54] FUEL INJECTION PUMP FOR INTERNAL COMBUSTION ENGINES, IN PARTICULAR FOR DIESEL ENGINES

[75] Inventor: Jean Claude Bonin, Blois, France

[73] Assignee: Roto Diesel, Blois, France

[21] Appl. No.: 650,447

[22] Filed: Jan. 19, 1976

[30] Foreign Application Priority Data

Jan. 31, 1975 France ..... 75.03094

[51] Int. Cl.[2] ..... F02M 39/00

[52] U.S. Cl. ..... 123/139 P; 123/139 R

[58] Field of Search ..... 123/139 P, 139 R, 137, 123/138

[56] References Cited

U.S. PATENT DOCUMENTS 2,833,263 5/1958 Evans ..... 123/139 R 3,314,406 4/1967 Kemp et al. ..... 123/139 R 3,446,148 5/1969 Glikin et al. ..... 123/139 R X

*Primary Examiner*—Edgar W. Geoghegan

[57] ABSTRACT

A fuel injection pump includes a cam which is movable to vary the timing of delivery of fuel by the injection pump. The cam is acted upon by a first piston which is subjected to the outlet pressure of a supply pump the piston acting on the cam to advance the timing of delivery of fuel. A second piston is provided which is subjected to the outlet pressure of the feed pump only when the engine speed attains a predetermined value. The first piston can move the cam against the action of a first light spring and a second relatively strong spring, the second spring being prestressed and being accommodated in the second piston.

5 Claims, 7 Drawing Figures

FUEL INJECTION PUMP FOR INTERNAL COMBUSTION ENGINES, IN PARTICULAR FOR DIESEL ENGINES

This invention relates to fuel injection pumps for supplying fuel to internal combustion engines, particularly diesel engines, the pumps being of the type comprising a rotor with a diametral bore within which two opposing pistons are able to slide, the inward stroke of the pistons being effected by fixed cam profile on a cam ring, the space between the two pistons being connected through a duct in the distributor head, alternatively with a fuel inlet and a fuel outlet, the outward stroke of the pistons under the action of fuel under pressure fed to said space being limited by a stop.

In pumps of this type, in order to vary the start of the injection in the advance or retard direction while running, the cam ring can usually be displaced in a rotary manner, independently from the rotation of the distributor rotor. This movement of the cam-ring during rotation can be ensured manually by an operator or by means of a hydraulically or a pneumatically operable piston working against spring return. In the case of a hydraulic piston, the motive power may be supplied by a pump which provides a pressure which is contingent upon speed.

In all cases, the beginning of the injection of fuel for a given rotational speed, varies with the injected output of fuel because the extent of outward movement of the pistons depends on the quantity of fuel supplied to the space. In consequence, when the fuel quantity varies, the instant at which inward movement of the pistons commences varies, the extent of variation being a function of the cam profile.

The object of the invention is to provide a pump of the kind specified in a simple and convenient form.

According to the invention a fuel injection pump for internal combustion engines comprises a rotor with a diametral bore within which two opposing pistons slide freely, with an inward stroke controlled by a fixed cam profile defined on a ring and acting on rollers supported by roller carriers slidable in a radial direction, said roller carriers being respectively in contact with the outer ends of said pistons, the space between the two pistons being connected by means of an axial duct in the rotor, on the one hand to fuel inlet ducts and on the other hand, to a delivery duct which is successively connected during the rotation of the rotor with an injector of the associated engine, the pump being characterised by the fact that it comprises a first piston slidable inside a bore in a housing, the said first piston being connected to the cam-ring in such a manner as to transmit angular movement thereto during movement of the first piston, one end of the first piston being subjected to fluid pressure which is a function of an operating parameter of the associated engine, a first compression spring located between the other end of the said first piston and one end of a second piston, said second piston being subject to the reaction of a main advance spring acting on said second piston against the first spring, the said main spring bearing against a third piston, and means allowing the third piston be subjected at a given rotational speed of the associated engine, to a fluid pressure opposing the said main spring and varying as a function of said operating parameter of the associated engine, the force generated by the pressure upon the third piston being greater than the force exerted by the first pressure on the first piston.

The pump according to the invention comprises a first piston sliding within a bore in the stator, the said first piston being connected to the cam-ring in such a manner as to transmit a rotary movement during the displacements, one end of the first piston being subject to fluid pressure according to an operating parameter of the associated engine, a compression spring being located between the other end of the said first piston and one end of a second piston, the said second piston being subject to the effect of a main advance spring reacting upon the said second piston against the first spring, the said main advance spring bearing against a third piston, and means allowing the third piston to be subjected by way of a given rotation speed of the associated engine, to a fluid pressure opposing the said main spring and function of the said operating parameter of the associated engine, the force generated by this pressure upon the third piston being greater than the force exerted by the first pressure on the first piston.

In one form, the first piston is connected to the ring by way of a ball-joint integral with the ring and acting in conjunction with an opening in the said first piston. In order to reduce the required space, one design according to the invention provides for a hollow third piston, the said second spring being located between the bottom of the recess of the said hollow piston and the said second piston. The driving pressures may be functions of the rotation speed of the associated engine, its output or any other parameter.

One example of a pump in accordance with the invention will now be described with reference to the accompanying drawings wherein.

Figure 1:
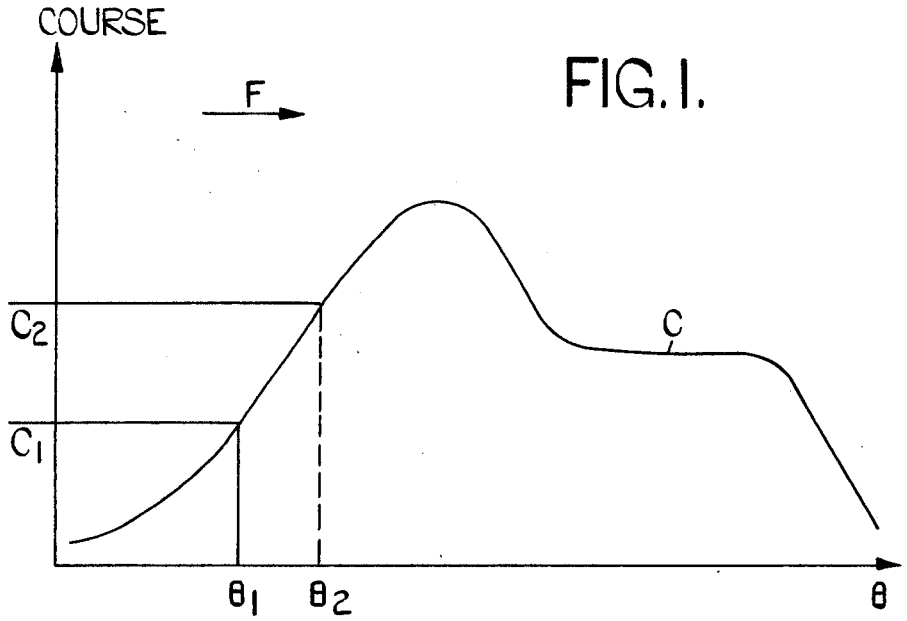
FIG. 1 shows an example of a developed cam profile.

Referring to FIG. 1, a developed profile C of a drive-cam for the pump pistons is shown, the abscissae representing the angular position B (in degrees) and the ordinates showing the stroke, the direction of rotation of the distributor rotor being shown by the arrow F. In the example shown here, a high output shown at position C1, corresponding to a large gap between the pistons results in contact with the cam at angular position $B_1$ on the cam, the contact corresponding with the initiation of the injection. In the case of a lower output shown at position $C_2$, the contact is initiated at the angular position $B_2$ on the cam. In the example shown here, $B_2$ is greater than $_1$, and consequently a reduction in output results in a delay or retarding of the injection.

Figure 2:
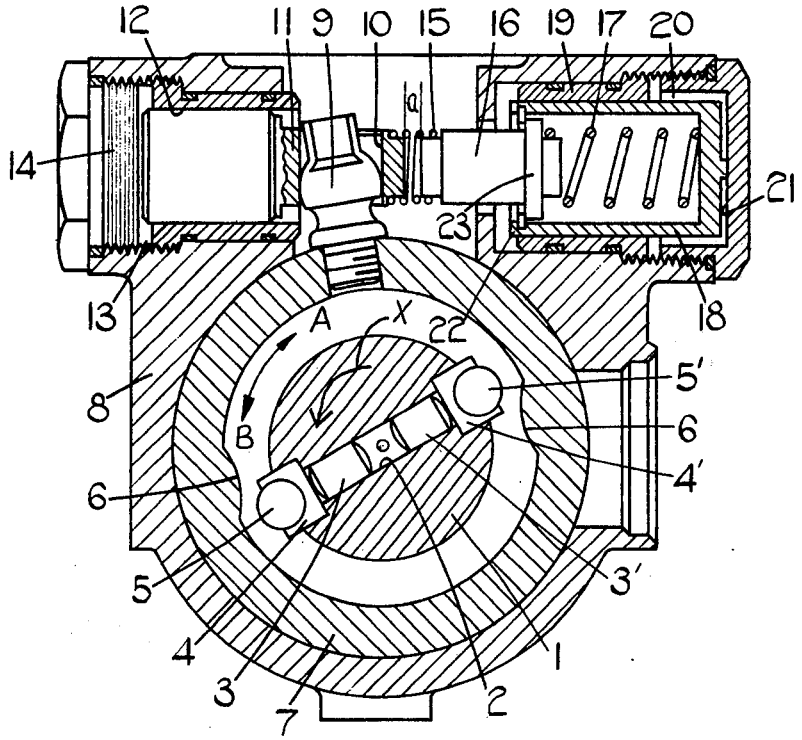
FIG. 2 is a cross-section through the pump shown in the rest position or start-up position with maximum retard.

Reference is now made to FIG. 2 representing a pump according to a design following the invention. The pump conventionally comprises a rotor 1 with a diametral bore 2 in which two opposing pistons 3 and 3' slide while bearing against roller-carriers 4 and 4', respectively. The carriers mount rollers 5 and 5' and are able to slide radially within the rotor 1. The rollers 5 and 5' operate in conjunction with cam lobes 6 formed on the inside of a ring 7 which is angularly movable about the axis of the rotor 1 within a housing 8. The space between the pistons 3 and 3' connects with a duct which in turn connects it on the one hand with fuel inlet ducts (not shown) and on the other hand, with an outlet passage (not shown) communicating in turn during the rotor rotation, with the injectors of the associated engine. Rotor 1 is driven at a speed which is a function of the associated engine in the direction of the arrow X as shown in FIG. 2, and angular movement of the ring 7 in relation to the housing 8 corresponds to an injection advance when rotated in the direction of the arrow A, and a delay or retard in injection when rotated in the direction of arrow B shown in the same figure of the drawings.

A ball-joint 9 is connected to the ring 7, and is located in a hole 10 formed in a piston 11. The piston is slidable within a bore 12 defined within the housing 8 to effect angular movement of the ring 7. One end of the piston 11 is subjected to a fluid pressure which is a function of an engine operating parameter in this case the speed of the associated engine, the fluid pressure being supplied to a chamber 13 defined by the bore 12 and a stop 14. The other end of the piston 11 bears against a helical compression spring 15 also bearing against one end of an intermediate piston 16. The other end of the intermediate piston 16 rest against a main advance spring 17 which bears against the bottom of a hollow piston 18. The piston 18 is slidable within a sleeve 19 which is integral with the housing 8, against the force of spring 17, under the effect of fluid pressure supplied to a chamber 20 demarcated by a stop 21. The hollow piston 18 also defines an annular stop 22 operating in conjunction with a collar 23 on the intermediate piston 16 in order to limit the relative movement of the pistons 16 and 18.

Figure 3:
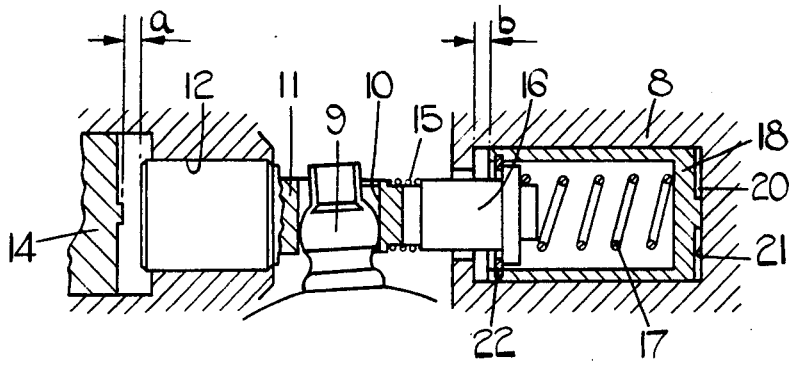
FIGS. 3, 4 and 5 show a part of FIG. 2 in different positions as will be explained.
Figure 6:
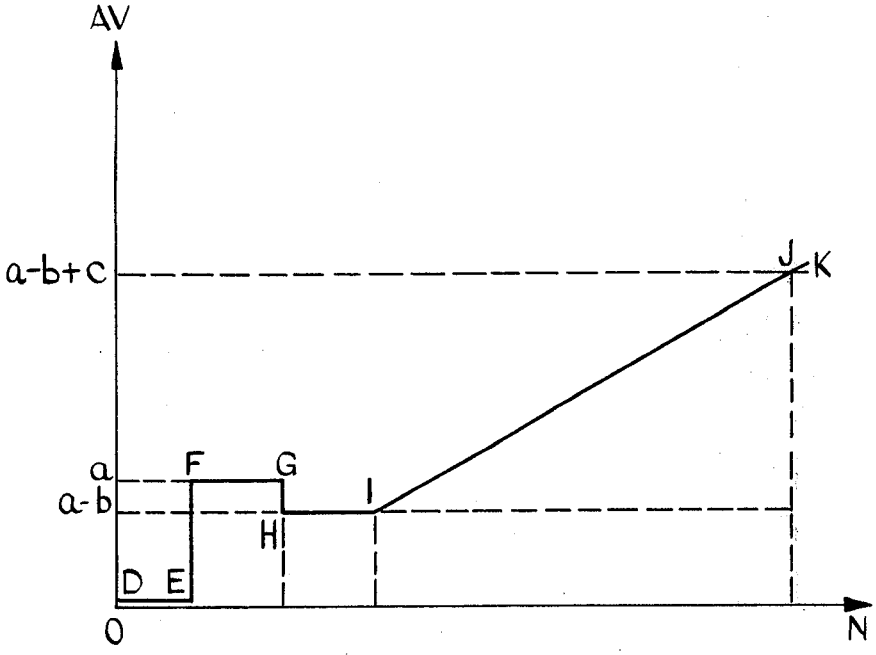
FIG. 6 is a curve representing the advance curve as a function of the associated engine rotational speed N (in revolutions per minute) and FIG. 7 shows the fuel circuit of the fuel pump.

In the rest position shown in FIG. 2, the piston 11 bears against the stop 14 under the force exerted by the spring 15, and this provides maximum retard this condition also existing during start-up as indicated by the portion DE of the curve in FIG. 6. The hollow piston 18 also bears against the stop 21 under the effect of spring 17 and the intermediate piston 16 bears against the stop 22 under the force exerted by the spring 17 which exerts a higher force than the spring 15. During starting of the engine, the fluid pressure applied to piston 11 is insufficient to compress the spring 15 and no fluid pressure is admitted to the chamber 20. As soon as the speed N reaches the value corresponding to points E and F on FIG. 6, the pressure applied to the piston 11 becomes sufficient to compress the spring 15 and piston 11 is moved by a distance *a* into contact with the intermediate piston 16 (FIG. 3). This movement of piston 11 causes angular movement of the ring 7 in the advance direction A along portion EF of the curve in FIG. 6. The force exerted on the piston 11 by the fluid pressure in the speed range FG is nevertheless insufficient to compress spring 17 and still no pressure is admitted into chamber 20. As shown in FIG. 3 pistons 16 and 18 are in contact with their respective stops 22 and 21. The engine is then subject to an advance addition required for good operation when idling, the advance being represented by the movement *a*.

Figure 4:
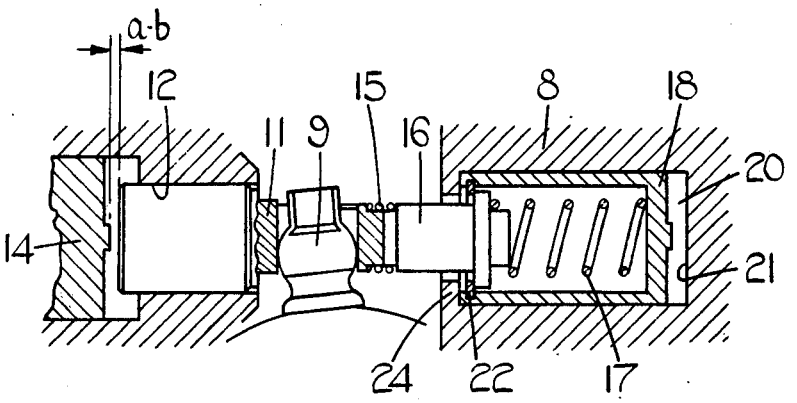

As soon as the rotational speed reaches the level corresponding to points G & H on the curve in FIG. 6, fluid pressure is admitted to chamber 20. The pressure admitted to chamber 20 is also a function of a parameter of the engine, in this case the engine speed, and is such that the force exerted upon piston 18 is greater than the force exerted on piston 11. Piston 18 is therefore moved until it comes to bear against a stop 24 on the housing 8 (FIG. 4). This movement of amplitude *b* induces an equivalent movement of piston 11 through the piston 16 and the spring 17. The stroke *b* is subtracted from the previous stroke *a* so that piston 11 is moved by a distance *a–b* in relation to its starting position. As a result slight retarding of the timing of injection takes place.

Figure 5:
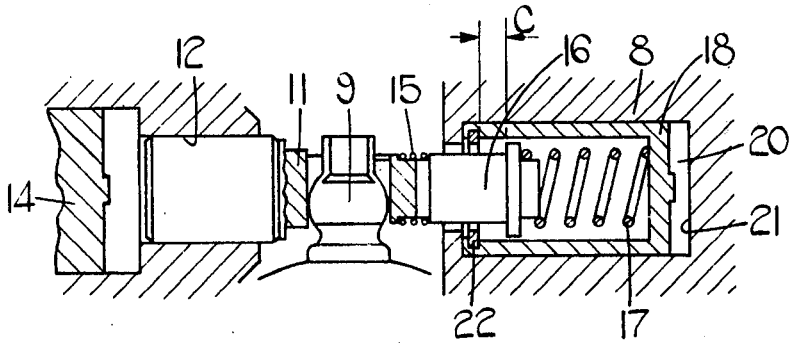

As the engine rotational speed continues to increase, the fluid pressures applied to the pistons continue to increase and piston 18 is retained against its stop 24. Only when the speed reaches a value corresponding to point I on FIG. 6, is the pressure acting on piston 11 sufficient to compress spring 17 and allow piston 11 to move towards the right (in the drawing), moving the ring 7 angularly in the advance direction A. This is the condition shown in FIG. 5. The advance increases simultaneously with the rotational speed according to section IK of the curve in FIG. 6. Point J of this section of the curve represents a movement *c* of piston 18 in relation to its stop 22, so that piston 11 moves by a value of $a - b + c$. The corresponding position of the assembly is shown in FIG. 5.

By altering the various available parameters, the curve in FIG. 6 can be given the required shape in accordance with the engine to be operated. The advance correction obtained according to the invention may be superimposed over an automatic retarding on start-up intended to compensate the advance increase created by an excess start-up flow (see FIG. 1), as well as with an advance adjusted according to speed and/or loading, for all conditions other than start-up and idling. The latter case simply involves a modification of the shape of portion IK of the curve in FIG. 6.

Figure 7:
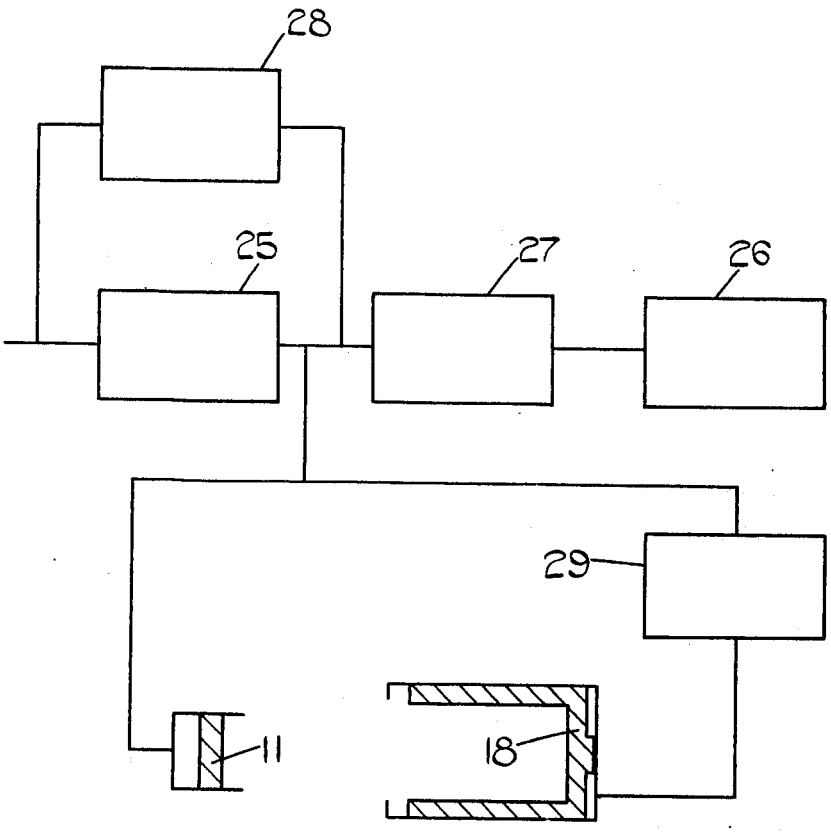

FIG. 7 shows the fuel circuit of the fuel pump. A feed pump 25 draws fuel from a supply (not shown) and supplies fuel under pressure to the injection pump 26 by way of a fuel quantity control 27. The injection pump 26 is constituted by the pistons 3, 3' and associated parts.

The outlet pressure of the feed pump 25 is determined by a valve 28 so that the pressure varies as a function of the speed at which the fuel pump is driven that is to say it varies as a function ofthe engine speed. As indicated the piston 11 is subjected directly to the outlet pressure of the feed pump whilst the application of the outlet pressure of the feed pump to the piston 18 is controlled by a valve 29. The valve itself is responsive to the outlet pressure of the feed pump so that it only opens to allow the application of pressure to the piston 18 at a predetermined pressure and hence engine speed.

I claim:

1. A fuel injection pump for internal combustion engines, particularly diesel engines, of the type comprising a rotor with a diametral bore within which two opposing pistons slide freely, the inward stroke of the pistons being controlled by a predetermined cam profile defined on a cam-ring engageable with rollers supported by roller carriers slidable within the diametral bore in a radial direction and respectively in contact with outer ends of said pistons, a space between the two pistons being connected by means of an axial duct in the rotor, on the one hand to fuel inlet ducts and on the other hand, to a delivery duct which is successively connected during the rotation of the rotor with an injector of the associated engine, the pump comprising a housing; a first piston slidable within a bore in said housing, the said first piston being connected to said cam-ring in such a manner as to transmit angular movement thereto during movement of the first piston; means for supplying fluid pressure to said bore to one end of the first piston which fluid pressure is a function of an operating parameter of the associated engine; a second piston slidable in said housing; a first compression spring located between the other end of said first piston and one end of said second piston; a main advance spring positioned within said housing at the other end of said second piston, said second piston being subject to the reaction of said main advance spring acting against said first spring, a third piston slidable in said housing; the said main spring bearing against said third piston; and means allowing said third piston to be subjected, at a predetermined rotational speed of the associated engine, to a fluid pressure opposing the said main spring and varying as a function of said operating parameter of the associated engine, the force generated by the pressure upon said third piston being greater than the force exerted by the first pressure on said first piston.

2. A pump according to claim 1, in which said first piston is provided with an aperture therein and is connected to the cam-ring by means of a ball-joint integral with said cam-ring and having one end thereof located within said aperture.

3. A pump according to claim 1, in which the third piston is a hollow piston, and said second spring is located between the bottom of said hollow piston and said second piston.

4. A pump according to claim 1, in which the said pressures are functions of the rotational speed of the associated engine.

5. A pump according to claim 1, in which the said pressures are functions of the output of the pump.

* * * * *